United States Patent [19]

Latasiewicz

[11] 4,387,282

[45] Jun. 7, 1983

[54] ELECTRICAL SWITCH ASSEMBLY

[75] Inventor: Leonard Latasiewicz, Hoffman Estates, Ill.

[73] Assignee: Motorola Inc., Schaumburg, Ill.

[21] Appl. No.: 241,266

[22] Filed: Mar. 6, 1981

[51] Int. Cl.[3] ..... H01H 13/44

[52] U.S. Cl. ..... 200/340; 200/159 B

[58] Field of Search ..... 200/340, 332, 335, 159 B, 200/5 A, 339, 330

[56] References Cited

U.S. PATENT DOCUMENTS

| | | | |
|---|---|---|---|
| 2,933,578 | 4/1960 | Hubbell et al. | 200/339 |
| 3,493,707 | 2/1970 | Castle | 200/335 |
| 3,800,104 | 3/1974 | Lien et al. | 200/5 A |
| 3,939,318 | 2/1976 | Brown et al. . | |
| 4,096,364 | 6/1978 | Lynn et al. | 200/159 B |
| 4,181,826 | 1/1980 | Latasiewicz . | |

OTHER PUBLICATIONS

U.S. Ser. No. 71,324, filed Aug. 30, 1979, Kopish.

*Primary Examiner*—Willis Little

*Attorney, Agent, or Firm*—Phillip H. Melamed; James S. Pristelski; James W. Gillman

[57] ABSTRACT

An electrical switch assembly (10) is provided having upper (11) and lower (12) housing portions which house a dome switch contact assembly (13). A switch actuator (20) substantially comprising a planar oblong plate (21) is mounted to a housing wall (41) of the upper housing portion (11) in a through opening (44) of the housing wall. The actuator (20) forms a hand insertable snap-in subassembly with the wall (41). The actuator (20) is intended for substantially pivotal movement from first to second predetermined positions such that in the second position a contact projection (26) attached to a second longitudinal end portion (25) of the actuator contacts the dome switch assembly (13) while flexible bias tangs (45, 46) apply mechanical bias to the actuator at a first longitudinal end portion (24) to position the actuator toward its first position.

19 Claims, 5 Drawing Figures

ELECTRICAL SWITCH ASSEMBLY

BACKGROUND OF THE INVENTION

The present invention relates to electrical switch assemblies wherein applying force to an actuator results in altering the electrical characteristics produced by electrical contacts influenced by the position of the actuator. More specifically, the present invention relates to electrical switch assemblies having a substantially pivotal manual actuator, and to such assemblies in which the actuator and a switch housing form a hand insertable snap-in subassembly.

Electrical switch assemblies having manual actuators are extremely well-known and typically comprise both linearly movable pushbutton actuators and pivotal rocking switch actuators wherein typically a bias spring, which is a component separate from the actuator and the housing for the switch assembly, is utilized to position the actuator in a predetermined position prior to the application of force thereto. Examples of such switch assemblies comprise the commonly used doorbell pushbutton switch and known rocker switch assemblies. Typically, the actuator in these prior assemblies does not form a hand insertable snap-in subassembly with the housing for the switch assembly, and this results in complicating the manufacturing of such switch assemblies. In addition, the provision for a separate spring bias member also complicates the manufacturing of these prior assemblies.

Some prior pushbutton assemblies exist wherein the pushbutton actuator does form a hand insertable snap-in subassembly with the housing for the switch assembly. An example of one of these pushbutton assemblies is illustrated in copending U.S. patent application Ser. No. 071,324, filed Aug. 30, 1979 and assigned to the same assignee as the present invention. The switch assembly shown in this copending application discloses mounting structure for producing a pushbutton assembly wherein the pushbutton actuator is linearly movable, and the mounting technique shown therein is not directly applicable to providing a hand insertable snap-in assembly for a pivotal manual actuator of a switch assembly. In addition, the pushbutton assembly shown in the copending U.S. application requires additional locking mechanisms to prevent the removal of the hand insertable snap-in pushbutton and this adds to the cost of the assembly. Also the applied manual actuation force directly opposes and must overcome the normal spring bias force applied to the actuator.

An electrical switch assembly having a manual actuator which is capble of both linear and pivotal actuation movement is illustrated in U.S. Pat. No. 4,181,826 assigned to the same assignee as the present invention. While the actuating member shown in the '826 patent is capable of pivotal movement, the switch assembly shown therein utilizes a separate actuator biasing pad to provide biasing force to the actuator wherein this bias force must be directly opposed and overcome by applied manual force in order to actuate the switch assembly. This construction does not provide for minimizing the actuation force necessary to cause the desired movement of the manual actuator resulting in a change in the electrical characteristics of the contacts.

The actuator in the '826 patent is not directly mounted to the switch housing, but is instead mounted to a printed circuit board carrying the electrical contacts of the switch assembly. This feature limits the manner in which the switch assembly can be constructed in that a complete subassembly is not formed between the housing and the actuator, but rather a subassembly is provided which involves the actuator, a spring biasing pad, and the printed circuit board. Mounting the manual actuator directly to the printed circuit board is not desirable since it will then be difficult to prevent the transmission of stress directly to the printed circuit board. Since there is no provision in the '826 patent for minimizing the amount of pressure transmitted through the actuator to the printed circuit board, the '826 assembly is subject to excessively stressing the printed circuit board which may result in damage to the switch assembly.

SUMMARY OF THE INVENTION

An object of the present invention is to provide an improved electrical switch assembly which overcomes the aforementioned deficiencies.

A more particular object of the present invention is to provide an improved electrical switch assembly having a pivotal manual actuator in which actuation can occur with a minimum amount of applied force and/or in which the actuator can be easily and directly assembled to a housing of the switch assembly.

Additional particular objects of the present invention are to provide a switch assembly which is relatively inexpensive, has relatively few component parts, and minimizes the amount of actuation force which must be applied to a pivotal actuator to result in altering electrical characteristics of contacts of the switch assembly.

In one embodiment of the present invention, an electrical switch assembly is provided which comprises: housing means for housing the electrical contacts of a switch, said housing means having a housing wall with at least one through hole opening therein; at least one switch actuator means mounted in said housing wall opening; retaining means for mounting said actuator means to said housing wall; bias means for applying a mechanical biasing force to said actuator means to maintain it in a first predetermined position and permitting said actuator means to move, in response to force applied to said actuator means which generally opposes said mechanical biasing force, into a second predetermined position; and electrical contact means mounted inside said housing means and adjacent said actuator means, said actuator means altering the electrical characteristics produced by said contact means in response to said actuator means moving from said first to second predetermined positions to thereby transmit force to said contact means, said assembly being characterized by, said actuator means substantially comprising a substantially planar oblong plate with major longitudinal and minor width axes and first and second longitudinal opposite end portions, and said biasing means comprising at least one flexible means contacting said first longitudinal end portion of said actuator means and providing said mechanical bias force thereto, said second longitudinal end portion having a contact projection affixed thereto, said biasing means readily permitting substantially pivotal movement of said actuator second longitudinal end portion about an axis disposed opposite said second longitudinal end portion of said actuator means and parallel to said minor width axis in response to the application of force, generally opposing said biasing force, to said second longitudinal end portion to thereby pivotally move said actuator means from said first to second positions wherein in said second position said contact projection contacts and alters the electrical characteristics of said electrical contact means.

Preferably, the retaining means for the electrical switch assembly is fixed to at least one of the actuator means and housing wall, and is constructed so that the actuator means forms a hand insertable snap-in subassembly with the housing wall. The flexible bias means applying said biasing force to the first longitudinal end portion typically comprises a pair of projecting tangs which are integral with the housing wall wherein the tangs and housing wall are formed from a molded plastic. Also preferably, the retaining means includes a flexible locking tab projection attached to said second longitudinal end portion of said actuator means that provides a locking ledge surface that coacts with an edge surface of the housing means, and preferably an end of said locking tab projection forms said contact projection. In addition said retaining means includes an extending projection fixed to the first longitudinal end portion of the actuator means which fits between said pair of flexible bias tangs and contacts said housing wall. Additionally, the housing wall has an integral peripheral shoulder formed about the housing wall opening and extending partially thereinto with portions of this shoulder adjacent to the first and second longitudinal end portions of the actuator means and providing stop surfaces for limiting the inward movement of each of these longitudinal end portions to thereby prevent the excessive application of force to the electrical contacts of the switch means and to the flexible biasing tangs which might be ruptured by allowing too large of an inward movement of the first longitudinal end portion in response to the application of manual pressure.

By virtue of the above recited limitations, a simplified electrical switch assembly has been provided which essentially comprises three basic elements consisting of a pivotal manual actuator substantially in the shape of an oblong plate, a housing wall having a through hole opening in which the actuator is mounted to form a hand insertable snap-in subassembly with the housing wall, and an electrical contact means, preferably comprising a dome switch assembly, mounted inside the housing and adjacent the pivotal actuator. The housing wall includes integral bias means for the actuator which eliminates the need for a separate biasing element. Since the biasing means contacts a first end of the actuator while a second opposite end is utilized to contact the electrical contacts within the housing, the manual force required to be applied to the second end portion to pivot the actuator about an axis opposite the second end is minimized.

In addition, the present invention contemplates providing a raised peripheral portion on the housing wall surrounding the housing wall opening and extending above the oblong plate of the actuator to prevent the application of side forces to the actuator which might damage the switch assembly. This raised peripheral portion also protects against accidental switch actuation which might occur, if the switch assembly was dropped on a flat surface.

BRIEF DESCRIPTION OF THE DRAWINGS

For a more complete understanding of the present invention, reference should be made to the drawings, in which.

DESCRIPTION OF THE PREFERRED EMBODIMENT

Figure 1:
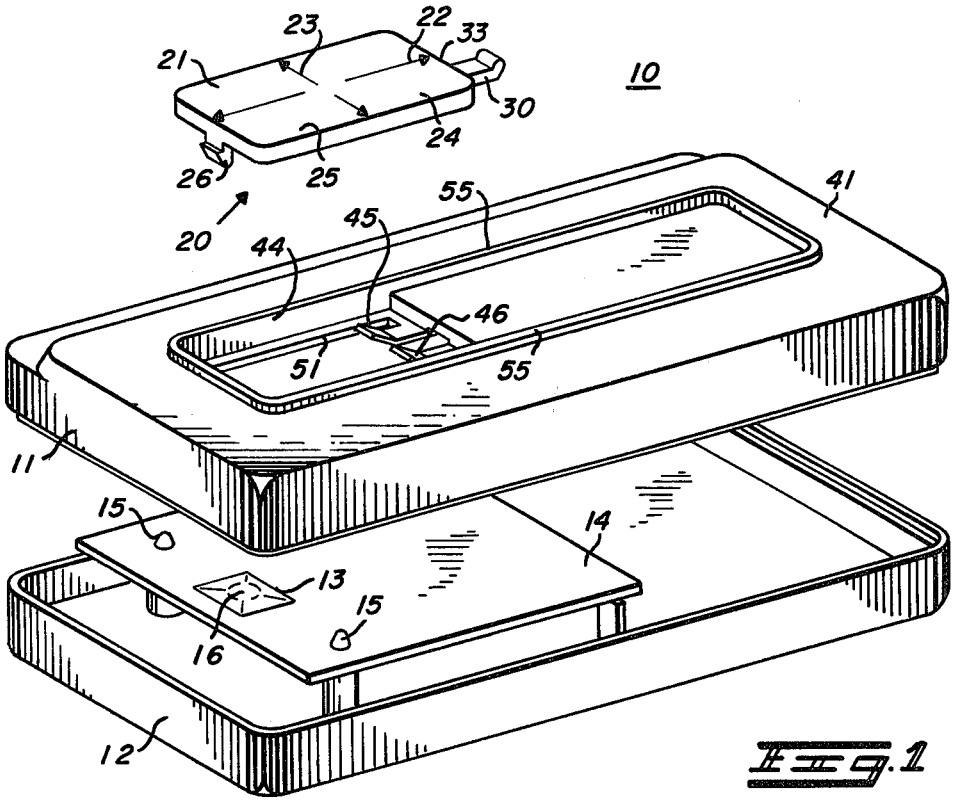
FIG. 1 is an exploded perspective view of an electrical switch assembly comprising an actuator, top and bottom housing wall portions, and an electrical contact assembly mounted on a printed circuit board coupled to the bottom housing wall portion.

FIG. 1 illustrates, in exploded perspective form, an electrical switch assembly 10 constructed in accordance with the teachings of the present invention. The switch assembly comprises a housing having upper and lower housing portions 11 and 12, respectively, which are intended for mating engagement via interlocking snap assembly or press fit assembly. The housing portions 11 and 12 form the housing for a set of electrical switch contacts for the switch assembly 10 wherein the switch contacts are illustrated as comprising a dome switch assembly 13 mounted on a printed circuit board 14 that is affixed to posts 15 attached to the lower housing portion 12. Dome switch assemblies such as the assembly 13 are well-known and assembly 13 comprises separated electrical conductor paths which are normally isolated but are electrically connected together in response to the application of mechanical pressure on an upstanding dome portion 16 of the dome assembly.

The electrical switch assembly 10 includes a switch actuator 20 which generally comprises a substantially planar oblong plate 21 with a major longitudinal axis 22, a minor width axis 23 and first and second longitudinal opposite end portions 24 and 25, respectively. The second longitudinal end portion 25 has a flexible contact projection 26 affixed thereto which is intended for contacting the dome 16 of the dome switch assembly 13 upon the application of downward (as viewed in FIG. 1) manual pressure to the second end portion 25 of the actuator 20. The dome switch assembly 13 is mounted adjacent the actuator 20 (see FIG. 5).

The contact projection 26 also comprises one part of a retaining means for the actuator 20 which results in providing a hand insertable snap-in subassembly between the actuator and the upper housing portion 11 in a manner to be subsequently described. The contact projection 26 basically comprises a flexible locking tab projection, also generally identified herein by the reference number 26, having an outer surface comprising an outwardly extending tapered cam surface 27 abruptly ending with an inwardly extending portion 28 which forms a locking ledge surface that coacts with an edge surface 40 (see FIG. 5) of a housing wall 41 of said upper housing portion 11 to aid in retaining said actuator 20 attached to said housing wall 41. The contact and locking tab projection 26 also has an end portion 29 which is intended for selective direct mechanical contact with the upstanding dome 16 of the dome switch assembly so as to institute changing the electrical characteristics of the dome switch assembly 13 in response to applying manual pressure to the actuator 20.

The actuator 20 also includes an extending projection 30 fixed to the first longitudinal end portion 24 of the actuator. The projection 30 acts as a retaining means for the actuator 20 and contacts inner surfaces 42 and/or 43 of the housing wall 41 and aids in retaining the actuator 20 to the upper housing portion 11 (see FIG. 5).

Figure 2:
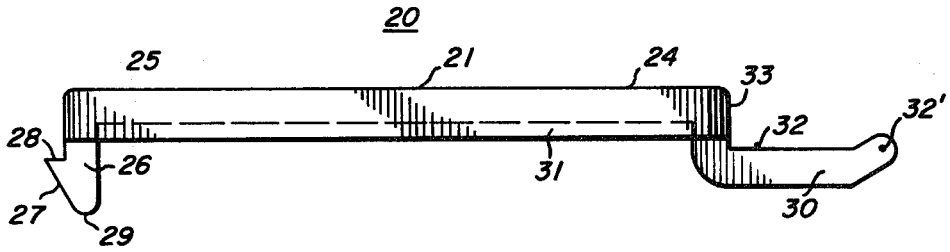
FIG. 2 is an enlarged planar side view of the actuator of the switch assembly shown in FIG. 1.
Figure 3:
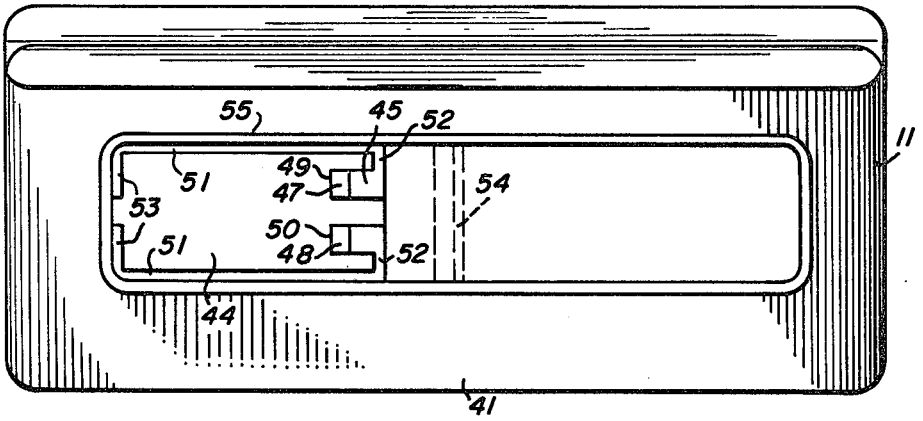
FIG. 3 is a planar top view of the upper housing portion shown in FIG. 1.
Figure 4:
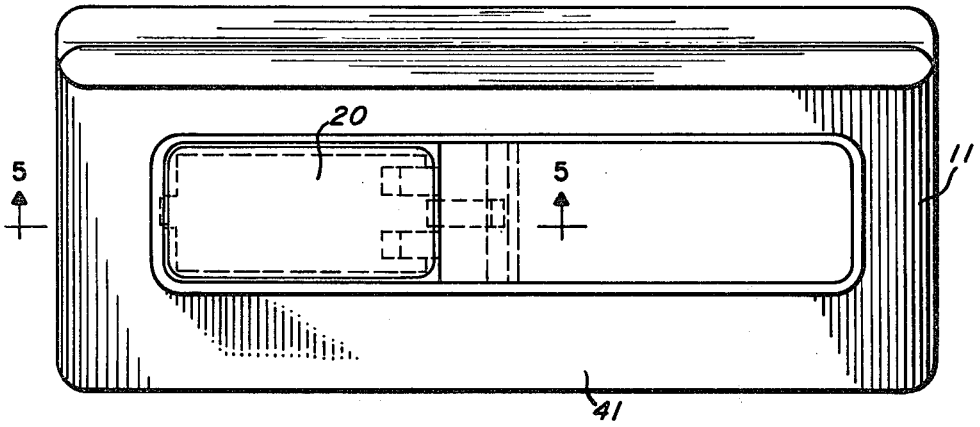
FIG. 4 is a planar top view of the assembled switch assembly shown in FIG. 1.

It should be noted that preferably the actuator 20 has an interior recessed portion 31 formed as part of the oblong plate 21, and preferably all of the elements 21-31 comprising the actuator 20 are formed by the injection molding of a plastic material to provide an integral actuator member. The details of the actuator 20 are best illustrated in FIGS. 1 and 2 of the drawings, whereas FIGS. 4 and 5 of the drawings illustrate how the actuator 20 is assembled to the upper housing portion 11 of the switch assembly 10 and how the actuator interacts with the other components of the switch assembly. FIG. 3 illustrates the details of the upper housing portion 11 and the housing wall 41.

The housing wall 41 includes at least one through hole opening 44 in which the oblong plate 21 of the actuator 20 is mounted. The housing wall 41 also includes, as an integral part thereof, a pair of flexible projecting tangs 45 and 46 which form an effective bias means for applying a mechanical biasing force to the first longitudinal end portion 24 of the actuator 20 to maintain the actuator in a first predetermined position, until the application of manual force, after the actuator is attached to the housing wall 41 by means of the retaining elements 26 and 30. The biasing force provided by tangs 45 and 46 permit the actuator 20 to move, in response to manual force applied to the second longitudinal end portion 25 of the actuator, which force opposes the biasing force applied by the tangs 45 and 46, such that the actuator will be pivotally positioned in a second predetermined position. The second predetermined position essentially corresponds to a substantially pivotal movement of the second longitudinal end portion 25 about an axis 32 or 32' disposed on the actuator 20 wherein both of the axes 32 and 32' are parallel to the minor width axis 23 and are located longitudinally opposite the second longitudinal end portion 25.

Figure 5:
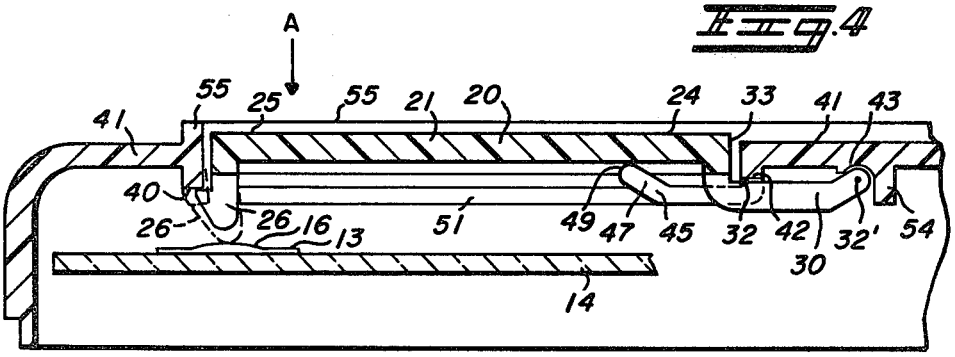
FIG. 5 is an enlarged cross-sectional view of the assembled switch assembly taken along the line 5—5 in FIG. 4.

It should be noted that the present invention contemplates the biasing tangs 45 and 46 contacting only the first end portion 24 of the actuator 20 to provide an upward bias force to the actuator 20 as viewed in the drawings. It is contemplated that the bias force applied to the first longitudinal end portion 24 will be sufficient to also apply a bias force through the oblong plate 20 to position the second longitudinal end portion 25 in the first predetermined position while permitting the pivotal movement of the end portion 25, which includes the contact projection 26, to its second predetermined position in response to the application of manual force to the end portion 25. FIG. 5 illustrates the first predetermined position for the actuator 20 by the solid line position of the contact projection 26, while the dashed position for the contacting projection 26 generally illustrates the second predetermined position of the actuator 20 which is provided in response to the application of manual pressure in the direction A, as illustrated in FIG. 5, applied against the second longitudinal end portion 25.

By viewing FIG. 5, it can be noted that in response to the application of manual force to the second longitudinal end portion 25, the actuator 20 will be moved from its first to second positions and implement substantially pivotal movement of the second end portion 25 and contact projection 26 about either the axis 32 or the axis 32' depending upon whether the surfaces 42 or 43 contact the extending portion 30 of the actuator 20. FIG. 5 also generally illustrates that the tangs 45 and 46 provide an upward biasing force to the actuator 20 which results in having the surface 40 and at least one of the surfaces 42 and 43 of the housing wall 41 contact various portions of the actuator 20 to maintain the actuator in its first predetermined position. It is significant to note that by utilizing the tangs 45 and 46 to apply biasing force to the first longitudinal end portion 24 of the actuator, this results in the positioning of the second longitudinal end portion 25 while permitting a minimum amount of manual force in the direction A to be applied to the second end portion 25 in order to overcome the biasing force applied by the tangs 45 and 46 and position the second end portion 25 in its second position so as to implement a change in the electrical characteristics provided by the dome switch assembly 13.

It should be noted that preferably the extending projection 30 of the actuator 20 is disposed between the pair of biasing tangs 45 and 46 and that preferably each of the tangs 45 and 46 comprise flexible extending projections of the housing wall 41 which extend into the opening 44 and have bent portions 47 and 48 having ends 49 and 50, respectively, which contact the first longitudinal end portion 24 of the actuator 20 substantially away from an outer peripheral edge 33 of the oblong plate 21. The edge 33 is located on the first longitudinal end portion 24 and is substantially parallel to the minor width axis 23. By having the tangs 45 and 46 contact the end portion 24 substantially away from the peripheral edge 33, this insures providing enough bias force to position both the first and second end portions 24 and 25 in their first predetermined positions. Only the ends 49 and 50 of the bent portions 47 and 48 contact the actuator 20 to minimize any inhibiting of pivotal movement of the actuator when manual force is applied.

The above construction provides for having the tangs 45 and 46 essentially provide for a biasing torque force for the actuator 20 which tends to rotate the actuator 20 about either of the axes 32 or 32' in a clockwise direction wherein this rotation is prevented due to the contacting of the locking ledge surface 28 with the housing wall surface 40. This is significant since applying manual pressure in the direction A to the second longitudinal end portion 25 effectively utilizes the length of the actuator 20 to counteract the biasing force of the tangs 45 and 46 and provide rotation of the second end portion 25 into the second predetermined position. Therefore, in FIG. 5 it can be seen that the present invention provides for effectively multiplying the applied manual force by a lever arm corresponding to the length of the actuator plate 21 so that the applied downward manual force in the direction A can be substantially less than the upward biasing force applied by the tangs 45. This is because the force applied by the tangs has a much shorter lever arm distance between the point of application of the force and the pivotal axes 32 and 32', as compared with the distance between these axes and the contact point for manual force applied to the end portion 25.

It should be noted that the present invention contemplates providing the actuator 20 and the upper housing portion 11 as a hand insertable snap-in subassembly. The assembly procedure comprises initially inserting the extending projection 30 of the actuator 20 between the flexible tangs 45 and 46 such that the extension 30 extends beneath the housing wall 41 and substantially adjacent the interior surfaces 42 and 43. Subsequently, manual pressure is applied to the second longitudinal end portion 25 of the actuator which results in the downward movement of the second end portion 25. During this downward movement, the contact projection 26, which was previously recited as being flexible, will be stressed and flex inwardly to an extent permitting the positioning of the oblong plate 21 within the through hole opening 44 of the housing wall 41. During insertion of the actuator 20 the tapered surface 27 rides on an edge of the surface 40. Once the locking ledge surface 28 of the contact projection 26 is located below the surface 40, the contact projection 26 will spring back to an unstressed position and result in locking the actuator 20 to the housing wall 41 via the upward bias pressure provided by the tangs 45 and 46 and the retaining contacts formed between the surfaces 28 and 40 and the extending projection 30 and the interior surfaces 42 and 43.

Due to the aforesaid construction, it is clear that the actuator 20 can be assembled to the upper housing portion 11 either prior to or after attaching the upper portion 11 to the lower housing portion 12, and this assembly flexibility aids in rendering the entire switch assembly 10 more manufacturable since the actuator 20 can be added to the switch assembly 10 at any of a number of different assembly step points.

Preferably, the housing wall 41 has an integral peripheral shoulder 51 formed about said housing wall opening 44 and extending partially thereinto. This shoulder 51 defines an interior cavity which is smaller than the through hole opening 44 and is smaller than the longitudinal and width dimensions of the actuator oblong plate 21. This shoulder 51 aids in retaining the actuator 20 to the housing wall 41 since even if the biasing force provided by the tangs 45 and 46 were not present, the shoulder 51, being smaller than the plate 21, would captivate the plate to the housing wall 41 when the effect of the shoulder 51 is considered in conjunction with the retaining function performed by the contact projection 26 and extending projection 30.

Additionally, the shoulder 51 forms first and second stop projection surfaces 52 and 53 adjacent the first and second longitudinal end portions 24 and 25 of the actuator 20, respectively. The stop surface 53 formed by the shoulder 51 coacts with the second longitudinal end portion 25 to prevent movement of the second longitudinal end portion from said first predetermined position to substantially beyond said second predetermined position. This is significant in that the stop surface 53 thereby prevents the excessive application of manual force to the dome 16 by virtue of excessive inward movement of the actuator 20 in response to the excessive application of manual force to the actuator. Similarly, the stop surface 52 of the shoulder 51 provides for selectively contacting the first longitudinal end portion 24 of the actuator 20 to thereby prevent any inward movement of the first longitudinal end portion 24, against the bias force provided by the biasing tangs 45 and 46, from said first predetermined position to beyond a predetermined inward position for the first longitudinal end portion 24. This structure thereby prevents any large inward movement of the actuator first longitudinal end portion 24 which might result in breaking off the biasing tabs 45 and 46. This could occur due to an unintentional application of excessive manual force to the first longitudinal end portion 24 rather than the second longitudinal end portion 25. The rupturing of the tangs 45 and 46 is thereby prevented by the shoulder stop surface 52 which prevents any inward movement of the first longitudinal end portion 24 beyond the maximum inward position fixed by the stop surface 52.

It should be noted that the present invention contemplates providing a stop projection 54 on the inside of the housing wall 41. This stop projection 54 is intended for contacting and cooperating with the extending projection 30 fixed to the first longitudinal end portion 24 of the actuator to thereby define a maximum longitudinal direction position for the actuator 20 with respect to the housing wall 41. Because the actuator 20 is intended for hand snap-in insertion into the housing wall 41, substantial tolerances exist with respect to fitting the actuator 20 into the through hole opening 44 in the housing wall 41. While the actuator 20 is being snapped into the housing wall 41, the end of the extending projection 30 will contact the stop projection 54 and generally locate the actuator 20 whereas upon the completion of the snap-in assembly inserting process, the stop projection 54 forms a stop surface barrier to prevent the longitudinal positioning of the actuator 20 from being beyond the position defined by the abutting of the extending projection 30 and stop projection 54.

An additional feature of the present invention is that the housing wall 41 includes a raised peripheral portion 55 extending outward from and above the housing wall 41 and substantially surrounding the housing wall through opening 44. The raised portion 55 extends above the housing wall 41 at least as much as the actuator oblong plate 21 extends above the housing wall 41 with the actuator in its first predetermined position, and this can best be seen in FIG. 5.

One significant advantage of the raised peripheral portion 55 is that it prevents the accidental application of side forces to the actuator 20. Clearly, the actuator 20 is intended to receive only downward manual pressure in the direction A (shown in FIG. 5) which should be applied to the second longitudinal end portion 25. The stop surface 53 guards against the excessive application of force in the intended direction and applied to the intended end portion 25. The stop surface 52 guards against manual force being applied in the intended direction A, but being applied to the wrong longitudinal end portion 24. The peripheral portion 55 guards against applying manual force in a sideways direction to the actuator 20, wherein this could possibly result in a shearing of the contacting projection 26 or the retaining extending projection 30.

Additionally, the raised peripheral portion 55 provides a raised surface surrounding the actuator 20 which will thereby inhibit the inadvertent removal of this element from the snap-in assembly formed by it and the housing wall 41. More significantly, the peripheral portion 55 results in recessing the actuator 20 such that accidental depression of the actuator 20 due to dropping of the entire switch assembly 10 will be less likely. If the assembly 10 is dropped on a substantially planar surface, the raised peripheral portion 55 will contact this planar surface rather than the actuator 20, and actuation of the dome switch assembly 13 will not occur. This is signiiicant since the switch assembly 10 shown in FIG. 1 is intended for use in electronic automatic garage door openers wherein it is likely that these openers may be dropped on the sidewalk or street, and it is desirable that in the event of such an occurrence, the dome switch assembly 13 should not be actuated.

It should be noted that the entire upper housing portion 11 is preferably formed by injection molding a plastic compound to form all of the features and elements designated by the reference numerals 40–55. One result of this is no separate actuator spring bias device is required since the tangs 45 and 46 are an integral part of the upper housing portion 11. Since the actuator 20 and all of its associated elements is also an integral component which is to formed by an injection molding process, the end result is an upper housing portion 11 and actuator 20 which form a two element subassembly. These two elements combine together and form a hand insertable snap-in actuator subassembly that cooperates with an electrical contact dome switch assembly 13 to provide an improved electrical switch assembly utilizing a minimum of separate components. While the number of components utilized for assembly of the improved switch assembly 10 is minimized, from the aforegoing description, clearly a number of significant advantageous benefits are obtained by the assembly of the present invention. These benefits lead to the development of an improved inexpensive switch assembly that is readily adaptable for use in automatic garage door opening devices wherein the closure of an electrical switch produces a signal that results in the energizing of a motor to automatically open a garage door.

While I have shown and described a specific embodiment of this invention, further modifications and improvements will occur to those skilled in the art. All such modifications and improvements which retain the basic underlying principles disclosed and claimed herein are within the scope of this invention:

I claim:

1. An electrical switch assembly comprising:

housing means for housing the electrical contacts of a switch, said housing means having a housing wall with at least one through hole opening therein;

at least one switch actuator means mounted in said housing wall opening;

retaining means fixed to at least one of said actuator means and said housing wall for mounting said actuator means to said housing wall and forming a hand insertable snap-in subassembly comprising said actuator means and said housing wall;

bias means for applying a mechanical biasing force to said actuator means to maintain it in a first predetermined position and permitting said actuator means to move, in response to force applied to said actuator means which generally opposes said mechanical biasing force, into a second predetermined position; and electrical contact means mounted inside said housing means and adjacent said actuator means, said actuator means altering the electrical characteristics produced by said contact means in response to said actuator means moving from said first to second predetermined positions to thereby transmit force to said contact means, said assembly being characterized by, said actuator means substantially comprising a substantially planar oblong plate with major longitudinal and minor width axes and first and second longitudinal opposite end portions, and said biasing means comprising at least one flexible means contacting said first longitudinal end portion of said actuator means and providing said mechanical bias force thereto, said second longitudinal end portion having a contact projection affixed thereto, said biasing means readily permitting substantially pivotal movement of said actuator second longitudinal end portion about an axis disposed opposite said second longitudinal end portion of said actuator means and parallel to said minor width axis in response to the application of force, generally opposing said biasing force, to said second longitudinal end portion to thereby pivotally move said actuator means from said first to second positions wherein in said second position said contact projection contacts and alters the electrical characteristics of said electrical contact means, wherein said retaining means comprises an extending projection fixed to said first longitudinal end portion of said actuator means which contacts said housing wall and aids in retaining said actuator means attached to said housing means and wherein said flexible means comprises a pair of projecting tangs fixed to said housing wall and located adjacent said first longitudinal end portion of said actuator means for contacting said first longitudinal end portion and providing said mechanical biasing force thereto, and wherein said retaining means extending projection which is fixed to said first longitudinal end portion of said actuator means is disposed between the pair of said biasing means projecting tangs.

2. An electrical switch assembly according to claim 1 wherein the first longitudinal end portion has an outer peripheral edge substantially parallel to said minor axis and wherein each of the tangs of said pair of biasing means projecting tangs comprises a flexible extending projection of said housing wall which has a bent portion having an end contacting said first longitudinal end portion of said actuator means at a point substantially away from said peripheral edge of said first longitudinal end portion.

3. An electrical switch assembly according to claim 2 wherein said retaining means, in addition to said extending projection, comprises at least one flexible locking tab projection having an outer surface with an outwardly extending tapered cam surface abruptly ending with an inwardly extending portion which forms a locking ledge surface that coacts with an edge surface on the other of said housing means and actuator means which said locking tab projection is not affixed to to retain said actuator means attached to said housing wall.

4. An electrical switch assembly according to claim 3 wherein said locking tab projection is fixed on said second longitudinal end portion of said actuator means and has an end portion which contacts said electrical contact means in said second predetermined position to institute changing the electrical characteristics of said contact means.

5. An electrical switch assembly comprising:

housing means for housing the electrical contacts of a switch, said housing means having a housing wall with at least one through hole opening therein;

at least one switch actuator means mounted in said housing wall opening;

retaining means fixed to at least one of said actuator means and said housing wall for mounting said acutator means to said housing wall and forming a hand insertable snap-in subassembly comprising said actuator means and said housing wall;

bias means coupled between said actuator means and housing means for applying a mechanical biasing force to said actuator means to maintain it in a first predetermined position and permitting said actuator means to move, in response to force applied to said actuator which generally opposes said mechanical biasing force, into a second predetermined position; and electrical contact means mounted inside said housing means and adjacent said actuator means, said actuator means altering the electrical characteristics produced by said contact means in response to said actuator means moving from said first to second predetermined positions to thereby transmit force to said contact means, said assembly being characterized by, said actuator means substantially comprising a substantially planar oblong plate with major longitudinal and minor width axes and first and second longitudinal opposite end portions, and said biasing means consisting primarily of flexible means contacting only said first longitudinal end portion of said actuator means and providing, by itself, said mechanical bias force thereto, said second longitudinal end portion having a contact projection affixed thereto and longitudinally spaced apart, along said plate, from the contact between said flexible means and said plate, said biasing means readily permitting substantially pivotal movement of said actuator second longitudinal end portion about an axis disposed opposite said second longitudinal end portion of said actuator means and parallel to said minor width axis in response to the application of force, generally opposing said biasing force, to said second longitudinal end portion to thereby pivotally move said actuator means from said first to second positions wherein in said second position said contact projection contacts and alters the electrical characteristics of said electrical contact means, the pivotal axis being positioned closer to the contact between said flexible means and said first longitudinal end portion of said plate than said second longitudinal end portion to which said contact projection is affixed.

6. An electrical switch assembly according to claim 5 wherein said first longitudinal end portion has an outer peripheral edge substantially parallel to said minor width axis and wherein said flexible means of said biasing means contacts said oblong plate of said actuator means substantially away from said edge of said first longitudinal end portion which is parallel to said minor axis, whereby said flexible means provides bias for positioning both said first and second longitudinal end portions of said oblong plate of said actuator means in said first predetermined position.

7. An electrical switch assembly according to claim 6 wherein said flexible means comprises at least one projecting tang attached to at least one of said housing wall and said actuator means.

8. An electrical switch assembly according to claim 7 wherein said projecting tang comprises a flexible extending projection of said housing wall which projects into said housing wall opening.

9. An electrical switch assembly according to claim 8 wherein said projection tang includes a bent portion having an end which contacts said first longitudinal end portion of said actuator means, whereby only said end of said bent portion of said projecting tang contacts said actuator means to provide said mechanical bias thereto.

10. An electrical switch assembly according to claim 5 wherein said housing wall has an integral peripheral shoulder means formed about said housing wall opening and extending partially thereinto, said shoulder means defining an interior cavity opening smaller than said housing wall opening and smaller than said actuator oblong plate, said shoulder means aiding in retaining said actuator to said housing wall and said shoulder means also forming at least one stop projection surface for limiting movement opposing said biasing force of both of said first and second longitudinal end portions of said actuator means.

11. An electrical switch assembly according to claim 5 wherein said housing wall has a stop projection surface adjacent to said second longitudinal end portion of said actuator means, said stop projection surface positioned for contacting said second longitudinal end portion of said actuator means to prevent movement of said second longitudinal end portion from said first predetermined position to substantially beyond said second predetermined position.

12. An electrical switch assembly according to any of claims 5, 8, or 11 wherein said housing wall has a stop projection means adjacent to said first longitudinal end portion for providing a stop surface for selectively contacting said first longitudinal end portion of said actuator means and thereby preventing movement of said first longitudinal end portion against the bias force provided by said biasing means from said first predetermined position to beyond a predetermined position, whereby rupturing of said biasing means is prevented by said stop projection means preventing too large of a movement of said first longitudinal end portion in response to the application of manual pressure opposing said bias force to said actuator means.

13. An electrical switch assembly according to claim 5 wherein said retaining means comprises at least one flexible locking tab projection having an outer surface with an outwardly extending tapered cam surface abruptly ending with an inwardly extending portion which forms a locking ledge surface that coacts with an edge surface on the other of said housing means and actuator means which said locking tab projection is not affixed to retain said actuator means attached to said housing wall.

14. An electrical switch assembly according to claim 13 wherein said locking tab projection is fixed on said second longitudinal end portion of said actuator means and has an end portion which contacts said electrical contact means in said second predetermined position to institute changing the electrical characteristics of said contact means.

15. An electrical switch assembly according to claim 14 wherein said retaining means, besides comprising said locking tab projection, comprises an extending projection fixed to said first longitudinal end portion of said actuator means which contacts said housing wall and aids in retaining said actuator means attached to said housing means.

16. An electrical switch assembly according to claim 15 wherein said housing wall has a stop projection which contacts said extending projection fixed to said first longitudinal end portion of said actuator means to thereby define a maximum longitudinal direction position of said actuator means with respect to said housing wall.

17. An electrical switch assembly according to claim 5 wherein said housing wall has a raised peripheral portion extending outward from and above said housing wall and substantially surrounding said housing wall through opening, said raised portion extending above said housing wall at least as much as said actuator means oblong plate extends above said housing wall in said first predetermined position, whereby the chance of accidentally applying undesired forces to said actuator means is minimized.

18. An electrical switch assembly comprising:

housing means for housing the electrical contacts of a switch, said housing means having a housing wall with at least one through hole opening therein;

at least one switch actuator means mounted in said housing wall opening;

retaining means fixed to at least one of said actuator means and said housing wall for mounting said actuator means to said housing wall and forming a hand insertable snap-in subassembly comprising said actuator means and said housing wall;

bias means for applying a mechanical biasing force to said actuator means to maintain it in a first predetermined position and permitting said actuator means to move, in response to force applied to said actuator means which generally opposes said mechanical biasing force, into a second predetermined position; and electrical contact means mounted inside said housing means and adjacent said actuator means, said actuator means altering the electrical characteristics produced by said contact means in response to said actuator means moving from said first to second predetermined positions to thereby transmit force to said contact means, said assembly being characterized by, said actuator means substantially comprising a substantially planar oblong plate with major longitudinal and minor width axes and first and second longitudinal opposite end portions, and said biasing means comprising at least one flexible means contacting said first longitudinal end portion of said actuator means and providing said mechanical bias force thereto, said second longitudinal end portion having a contact projection affixed thereto, said biasing means readily permitting substantially pivotal movement of said actuator second longitudinal end portion about an axis disposed opposite said second longitudinal end portion of said actuator means and parallel to said minor width axis in response to the application of force, generally opposing said biasing force, to said second longitudinal end portion to thereby pivotally move said actuator means from said first to second positions wherein in said second position said contact projection contacts and alters the electrical characteristics of said electrical contact means, wherein said flexible means comprises at least one projecting tang comprising a flexible extending projection of said housing wall which projects into said housing wall opening, and wherein said projecting tang and said housing wall are integrally formed.

19. An electrical switch assembly according to claim 18 wherein said integral projecting tang and housing wall are formed from molded plastic.

* * * * *